United States Patent [19]

Wood

[11] Patent Number: 4,799,719

[45] Date of Patent: Jan. 24, 1989

[54] MOTOR OPERATED LOCK

[76] Inventor: George Wood, 7539 Thurow, Houston, Tex. 77087

[21] Appl. No.: 64,340

[22] Filed: Jun. 18, 1987

[51] Int. Cl.[4] ..... E05C 1/06

[52] U.S. Cl. ..... 292/144

[58] Field of Search ..... 292/341.16, 92, 144, 292/201

[56] References Cited

U.S. PATENT DOCUMENTS

| | | | |
|---|---|---|---|
| 2,785,916 | 3/1957 | Mutti | 292/144 |
| 3,881,171 | 4/1975 | Moorman et al. | 70/271 |
| 4,314,722 | 2/1982 | Logan, Jr. | 292/92 X |
| 4,592,453 | 6/1986 | Fish et al. | 70/269 |
| 4,593,543 | 6/1986 | Stefonek | 292/144 X |
| 4,593,545 | 6/1986 | Terry et al. | 70/269 |
| 4,640,108 | 2/1987 | Young | 70/129 |
| 4,659,121 | 4/1987 | McGee | 292/144 |

FOREIGN PATENT DOCUMENTS

| | | |
|---|---|---|
| 2634107 | 2/1978 | Fed. Rep. of Germany . |
| 2062741 | 5/1981 | United Kingdom . |
| 2117823 | 10/1983 | United Kingdom . |
| 2135380 | 8/1984 | United Kingdom . |

*Primary Examiner*—Richard E. Moore

*Attorney, Agent, or Firm*—Pravel, Gambrell, Hewitt, Kimball & Krieger

[57] ABSTRACT

A motor operated lock wherein the motor is translated when the motor shaft rotates, the motor shaft acting as the bolt of the lock and engaging or disengaging the door to lock or unlock the door. The motor is located on a fixed platform and is moved by the cooperation of a nut affixed to the platform and a threaded portion of the motor shaft. The assembly can be located inside or exterior the wall and can be adapted for easy removal. The motor direction and travel limits are controlled by appropriate electrical circuitry.

13 Claims, 3 Drawing Sheets

MOTOR OPERATED LOCK

BACKGROUND OF THE INVENTION

1. Field of the Invention

The present invention relates to electrical locks used in entry and exit passages and other access controlled areas.

2. Description of the Prior Art

Electrically controlled locks are commonly used in many security applications. The flexibility provided by an electric lock assembly allows the opening and closing of the lock to be remotely controlled from a guard station to allow limited access to a facility. Additionally, use of an electric lock assembly can allow the time of access to be controlled using a time clock mechanism, as is common in bank vaults for instance.

The two most common types of electric locks in use today are those that are magnet operated and those that are solenoid operated. The magnetically operated types use a magnetic field producing apparatus on a fixed portion of the door frame and a magnetically attracted material on the door so that when the magnetic field is energized, the door is locked due to the magnetic force and when the field is de-energized, the door is unlocked and can be freely opened. A magnetic lock therefore requires the constant use of a magnetic field and the involved heat and electrical current, to maintain the door in a locked condition. Additionally, should the power fail, the lock would be disabled and the door would be opened, allowing entry to the facility.

The other common type of electrically operated lock is a solenoid type mechanism wherein the energizing of a solenoid either engages a bolt or disengages a bolt, thereby appropriately locking or unlocking the door. One major problem with a solenoid system is that the solenoid is not suitable for continuous duty use because it will overheat and therefore become inoperable after a certain period of time, generally measured in minutes. This condition is shown in U.S. Pat. No. 4,640,108 where a time-delay relay was included to de-energize the solenoid after 1.5 seconds to preclude solenoid damage. This time period dramatically limits when the solenoid can be energized and the door can be in an open or closed position therefore effectively requiring constant attention by an operator to control the lock.

U.S. Pat. No. 4,592,453 discloses a lock assembly using a clutch to allow door knob rotation to be transmitted to a latch assembly. A motor is used to engage and disengage dogs used to control the clutch for the coaxial transmission of the knob rotation. This is a cumbersome and complicated method and requires the use of a conventional bolt for locking the door to the door jamb.

SUMMARY OF THE INVENTION

The lock of the present invention uses a motor to drive a deadbolt into and out of a door. The motor is actuated in a first direction to cause a rotation of the motor shaft, which is then converted into a linear, translational motion which is in turn transmitted to the bolt which is projected through the door jamb and into the door. The travel of the deadbolt into the door is discontinued on the signal of a feedback switch connected to an appropriate moving member to sense when the lock is fully closed. When the lock is desired to be opened, the motor is actuated to run in a reverse direction and thereby withdraw the bolt from the door, into the door jamb and the wall. The withdrawal motion of the bolt is discontinued on the signal of a second feedback switch which senses when the bolt is sufficiently withdrawn to allow the door to be opened.

In one embodiment, the motor itself actually slides along a path such that the motor shaft is the deadbolt. In this embodiment, the motor shaft contains a threaded portion which is connected to a nut having a fixed location to allow the motor to move transversely because the rotational motion of the shaft is converted to translational motion. The feedback switches indicate when the motor has reached the fully opened or fully closed position to disable the motor drive to prevent damage to the motor.

The controls for the lock are designed such that the lock can preferably be opened only during certain intervals governed by timers and requiring the use of a second, secure switch to actually initiate opening of the lock. If the time period as indicated by the timers has expired, the lock automatically closes.

The use of the motor overcomes any continuous duty cycle and power draw problems present in prior electrical locks because as the motor is not always in an energized condition, but is energized only during the travel of the bolt and not during holding periods, the power draw and energizing time are low.

DESCRIPTION OF THE PREFERRED EMBODIMENT

Figure 1:
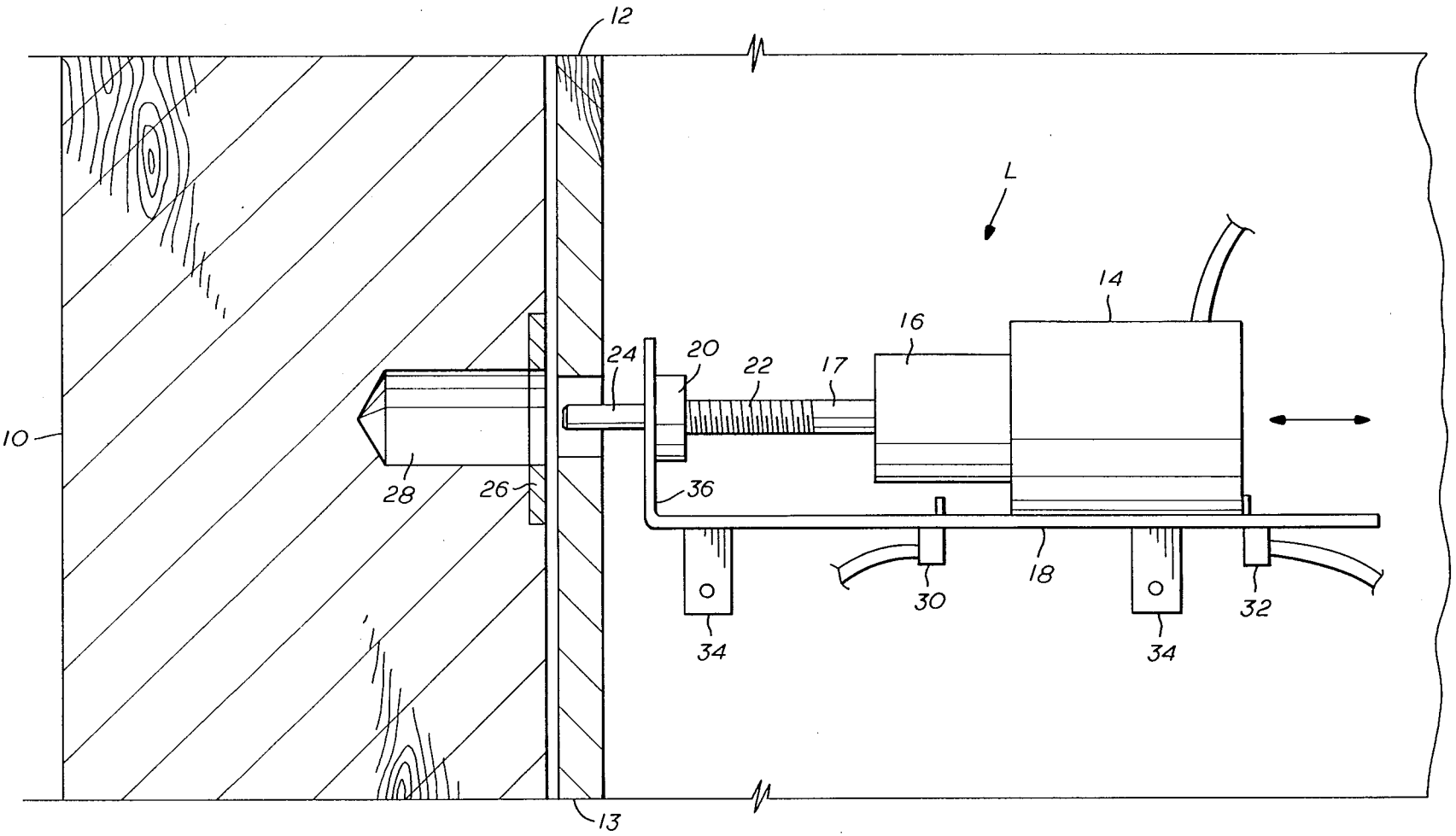
FIG. 1 is a partial, cross-sectional side view of a lock according to the present invention installed in a wall.

Referring now to FIG. 1, the letter L generally represents a lock according to the present invention. The lock L is mounted in a wall 12 and is used to lock a door 10. A frame 18 is mounted inside the wall structure by means of brackets 34 to form a fixed frame onto which to mount the movable portions of the lock L. The frame 18 includes a vertical member 36 which is parallel to the door frame or jamb 13 and the door 10. The vertical frame member 36 contains a through-hole and has attached a fixed nut 20, the opening of the nut 20 being coaxial with the opening or through-hole in the vertical member 36. The nut 20 is rigidly attached by welding, brazing or other technique to the vertical member 36 so that it cannot rotate. A motor 14 and if desired, depending on motor 14 rotational speed and nut 20 pitch, a gear reducer or speed reducer 16 attached to the motor 14, are located on the frame 18 in a slidable configuration. The output shaft 17 of the gear reducer 16 contains a threaded portion 22 and a smooth portion 24. The threaded portion 22 is adapted to be mated with the nut 20 to provide a rotational to translational motion transformation. The smooth end 24 is the bolt which is inserted into a door cavity 28 through a striker plate 26.

When the motor 14 is energized, the output shaft 17 rotates. The cooperation between the nut 20 and the threaded portion 22 of the shaft then causes the motor 14, gear reducer 16 and shaft 17 to slide or translate along the frame 18 alternately engaging and disengaging the smooth end 24 and the door 10.

Located in appropriate positions on the frame 18 are a closed switch 30 and an opened switch 32. The closed switch 30 indicates when the motor 14 has moved to the fully closed position and the motor 14 can be de-energized, while the opened switch 32 indicates when the motor 14 has reached the fully opened position and the motor 14 can be de-energized. While in the illustrated embodiments the opened and closed switches 30, 32 are shown mounted to the frame 18 and activated by direct contact with the motor 14, it is understood that the switches can be remotely mounted and activated by the appropriate linkages or can be non-contact switches, such as Hall effect switches, the switches only needing to provide a feedback signal indicating when the motor 14 has reached the fully open or closed position.

The lock L in FIG. 1 is shown in the opened position. If the motor 14 is energized, the cooperation of the fixed nut 20 and the threaded shaft 22 cause the motor 14 to slide transversely and the smooth shaft 24 to project into the door cavity 28. The motor 14 continues to slide transversely until it is deactivated due to the action of the motor engaging the closed switch 30.

To open the lock L, the motor 14 is energized to rotate in the opposite direction. The cooperation of the nut 20 and the threaded shaft 22 would slide the motor 14, withdrawing the smooth shaft 24 from the door 10 into the wall 12. The motor 14 continues to slide until it is deactivated due to the action of the motor 14 engaging the opened switch 32.

Alternatively, the lock L can have the motor components mounted externally of the wall to allow the lock assembly to be rapidly removed in case of an emergency. Two end plates 42,44 are used in conjunction with connecting bearing rods 40 to perform the equivalent function of the fixed structure 18 in FIG. 1. The bearing rods 40 can be fastened to the end plates 42,44 by means of self-locking nuts or other suitable means, to allow ease of assembly and maintenance. The nut 20 is located on the fixed end plate 42 and cooperates with the threaded shaft 22 to allow the motor to slide transversely along the bearing rods 40 as necessary. The deadbolt 46 is L-shaped, projects through one wall 38 and is of sufficient length to allow the deadbolt 46 to be inserted into the door cavity 28. Thus the lock L can be mounted at variable distances from the door 10 by means of longer deadbolts 46, allowing easier placement of the lock L.

Figure 4:
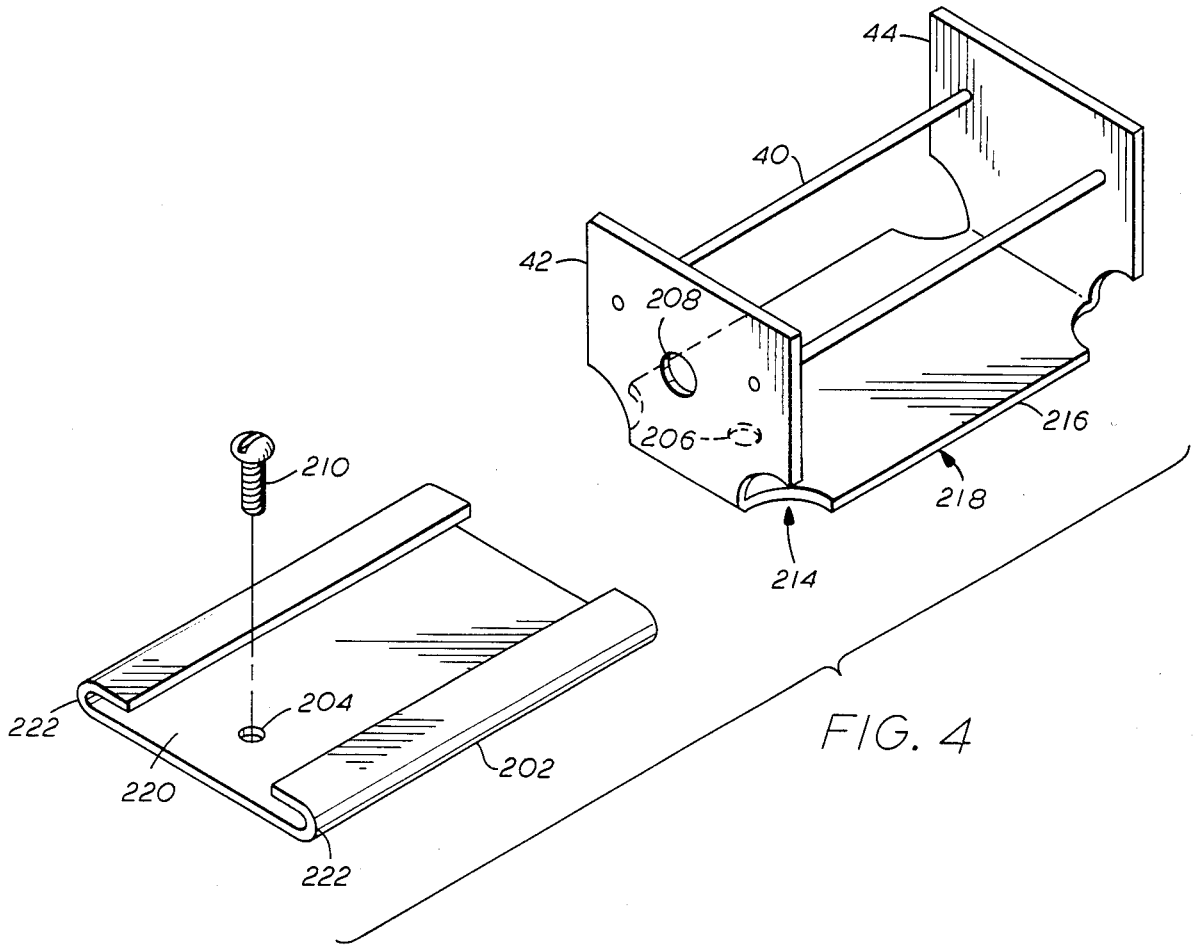
FIG. 4 is an exploded view of portions of a lock according to the present invention.

The embodiment shown in FIG. 4 can easily be removed in case of an emergency. The embodiment of FIG. 4 does not show the motor 14, shaft 17 or switches 30, 32 for reasons of clarity. A base plate 202 is mounted to the wall to form a fixed reference. The base plate 202 preferably includes a flat portion 220 and rolled sides 222. The flat portion 220 includes a hole 204 to be used in conjunction with a pin 210 to lock a motor frame 218 to the base plate 202.

Figure 2:
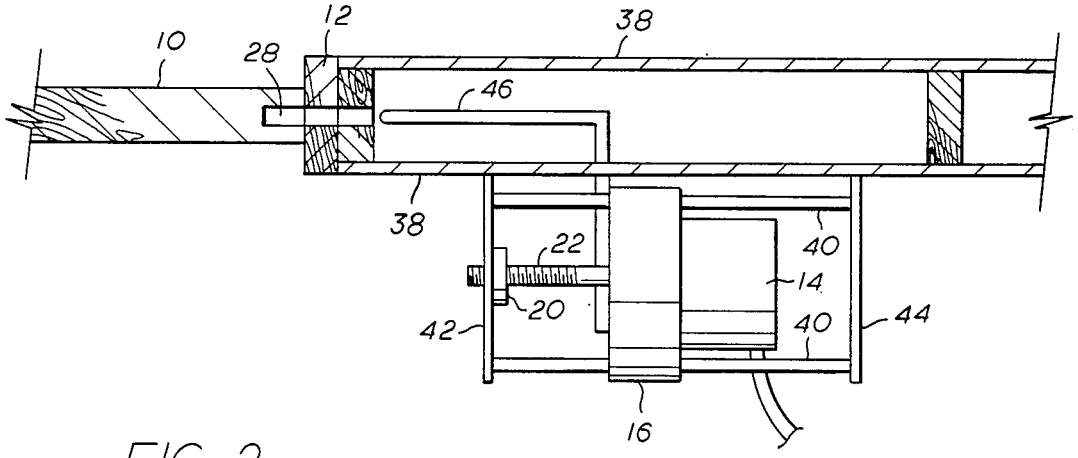
FIG. 2 is a partial cross-sectional top view of a lock according to the present invention installed in a wall.

The motor frame 218 is preferably a U-shaped piece having end plates 42, 44 and a bottom 216. Two bearing rods 40 span the frame 218 and are attached to the end plates 42, 44 in a similar manner as the embodiment of FIG. 2. A through-hole 208 is located in one end plate 42. The frame 218 includes cutout corners 214 to allow the bottom 216 to mate with the rolled sides 222 of the base plate 202. In this manner the frame 218 can be slid into and out of the base plate 202 as desired.

The bottom 216 contains a hole 206 designed to cooperate with the pin 210 and the hole 204 in the base plate 202. When operation of the lock L is desired, the pin 210 is inserted through the holes 204, 206, thereby fixing the motor frame 218 and the base plate 202 in a fixed relationship, so that the smooth shaft 24 or deadbolt 46 can be driven by the motor 14 into the door 10 and the lock L operated normally. If the lock L is in a closed position and an exit is needed, for example in the case of an emergency condition such as a fire or if the electrical power has failed, the pin 210 can be pulled and the motor frame 218 removed from the base plate 202, thus removing the smooth shaft 24 or deadbolt 46 from the door 10. When normal operation is desired, the motor frame 218 is slid into the base plate 202 and the pin 210 is reinstalled.

Figure 3:
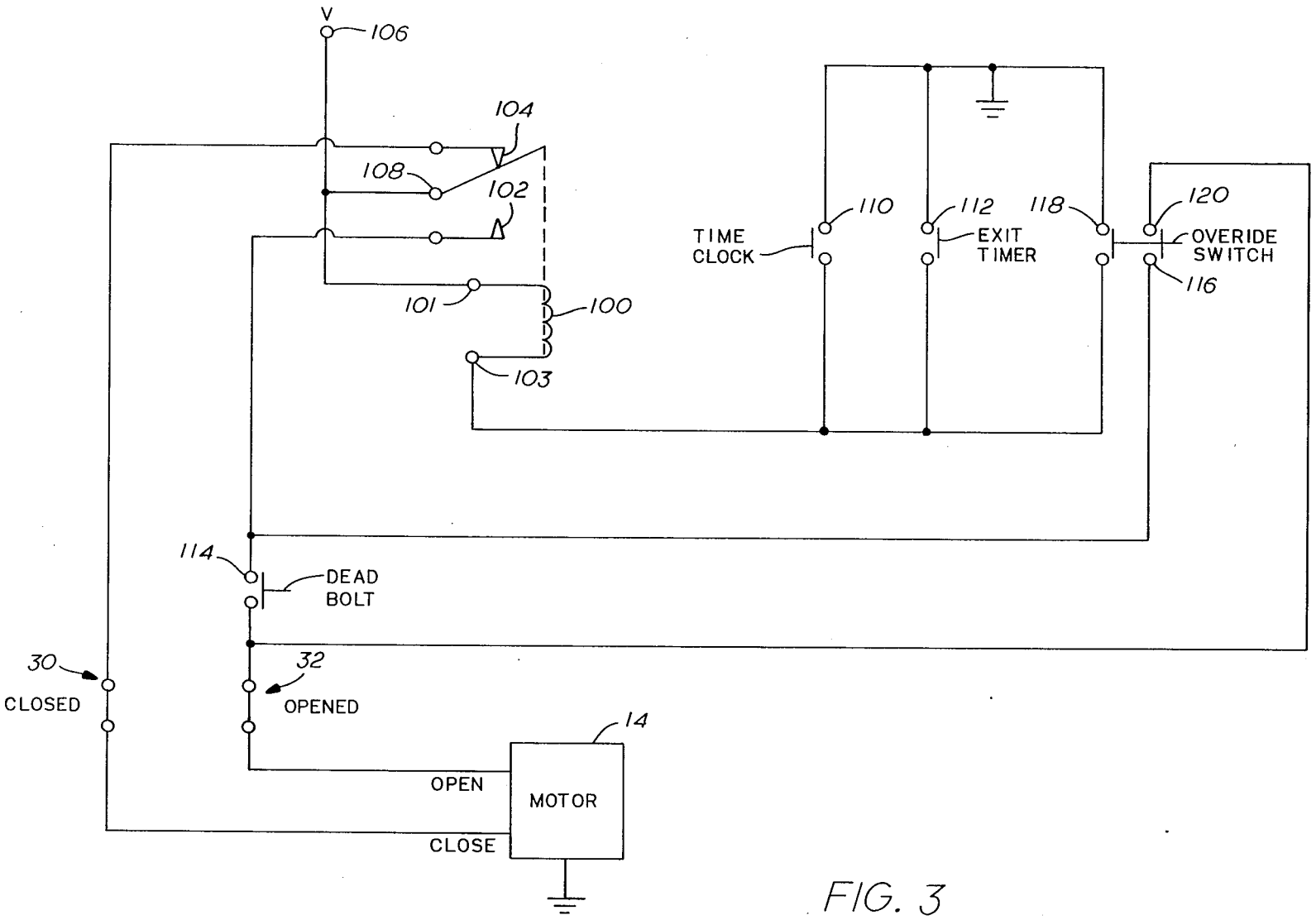
FIG. 3 is an electrical schematic diagram of the operating circuitry of a lock according to the present invention.

The motor 14 is a reversible motor to allow the lock L to be opened and closed. For this reason, it is necessary to provide control logic (FIG. 3) to energize the appropriate opening and closing leads of the motor 14 and to shut off power to the motor 14 when the motor has reached the appropriate travel point and the lock L is fully closed or fully opened.

The direction of movement is controlled by the use of a direction relay 100 having a set of normally opened contacts 102 and a set of normally closed contacts 104 configured in a single-pole, double-throw or Form C configuration. One relay terminal 101 and the central contact 108 are connected to a suitable voltage source 106. The voltage source can be alternating current or direct current as necessitated by the motor design. The other relay terminal 103 is connected to ground through a parallel set of switch contacts, one set being time clock contacts 110 and the other set being exit timer contacts 112. The time clock contacts 110 are normally open and are closed only during time-controlled intervals as determined by the time clock. The time clock is used to provide intervals where the building can be reentered from the outside, with no one inside. Preferably, the time clock is a 24 hour battery driven time clock or battery backed-up time clock which allows variable set points of varying intervals so that the lock L will be able to be opened at certain preset times. The exit timer contacts 112 are normally open and are connected to an exit timer which has a sufficient time delay once energized to allow a person to exit the door and to allow sufficient time for other necessary items which the person might be carrying to be removed without having the lock L closing while the door 10 is in the open position.

When the relay 100 is de-energized, the lock closed position, the normally closed contact set 104 connects the voltage source 106 to the closed switch 30. The closed switch 30 is located in a physical relationship to the motor 14 such that the switch 30 is closed until the motor 14 has reached the fully closed position, at which time the closed switch 30 opens, thereby disconnecting power to the motor 14 and ending the motor 14 travel. The closed switch 30 thus performs a feedback function to indicate motor position. When the relay 100 is not energized, the logic automatically causes the motor 14 to drive the lock L closed, so that the lock L normally rests in the closed position.

When either the time clock contacts 110 or exit timer contacts 112 are closed and therefore relay 100 is energized, the normally opened contacts 102 are closed and electrical power is transmitted through deadbolt switch 114, if closed, and the opened switch 32 to the open winding of the motor 14. The opened switch 32 performs in a like manner to the closed switch 30 in that it is normally closed when the motor 14 is not in the fully opened position, and opens when the motor 14 is in the fully opened position, thereby preventing damage to the motor 14 and the lock L.

The deadbolt switch 114 is positioned in series with the opened switch 32 to provide additional security. If the deadbolt switch 114 were not present, the lock L would be opened whenever the exit timer contacts 112 or the time clock contacts 110 were closed. The use of the deadbolt switch 114 allows the actual opening of the lock L to be performed only when passage through the door 10 is desired. Preferably, the deadbolt switch 114 is a switch which is key activated and can be combined with a standard deadbolt lock for added security.

When both the deadbolt switch 114 and the opened switch 32 are closed, and the relay 100 is in the open position, the motor 14 will be energized to open the lock L. The motor 14 will travel until it is in the fully opened position at which time the opened switch 32 stops the travel of the motor 14. The motor 14 will stay in the fully opened position until both the exit timer 112 and the time clock contacts 110 are opened and the relay 100 returns to the de-energized or close position. At this time, the lock L begins its automatic closure and operates as previously described.

An optional override switch 116 is shown having a pair of normally opened contacts. The first set of contacts 118 is connected in parallel with the timer contacts 110, 112 to energize the direction relay 100. The second set of contacts 120 is used to parallel the deadbolt switch 114 so that hitting only a single switch is required to open the lock L. The override switch 116 can be used to open the door to allow guests or other visitors to enter the building without having to actuate the exit timer, which has a preferable time limit of 5 minutes. Additionally, use of the override switch 116 allows the opening of the door without the use of the deadbolt switch 114 and any key associated with it, eliminating this burden.

While there is only one control circuit shown for the lock L, it is understood that the various timer switches and deadbolt switches could be operated by various means, such as radio-controlled switches, magnetically-operated switches and other devices well known to those skilled in the art. Additionally, the shown components are electromechanical but it is understood that electronic equivalents could be used to duplicate and further enhance the security and motion control logic.

The foregoing disclosure and description of the invention are illustrative and explanatory thereof, and various changes in the size, shape and materials as well as in the details of the illustrated construction may be made without departing from the spirit of the invention, all such changes being contemplated to fall within the scope of the appended claims.

I claim:

1. An electrical lock for preventing relative movement between first and second closure members, comprising:

reversible electric motor having a rotatable shaft, for mounting on the first closure member;

bolt means adapted and positioned to move from the first closure member to the second closure member;

bolt engagement means for mounting on the second closure member for the bolt means to engage to lock the second closure member in place relative to the first closure member;

means for converting rotational motion of said shaft to translational motion, said converting means connected to said bolt means and said motor shaft, so that when said motor shaft rotates, said bolt means moves translationally; and means for selectively activating said electric motor for selectively moving said bolt means into and out of engagement with said bolt engagement means for respectively locking and unlocking the closure members.

2. The lock of claim 1, further comprising:

frame means for attachment to the first closure member for providing a fixed location and structure, wherein said motor and said bolt means are slidably attached to said frame means and said converting means is fixedly attached to said frame means.

3. The lock of claim 2, wherein said converting means includes a nut and said motor shaft includes a threaded portion for cooperating with the nut.

4. The lock of claim 3, wherein said motor shaft forms said bolt means.

5. The lock of claim 2, wherein said frame means includes:

a first portion for fixed attachment to the first closure member, said first portion including a hole;

a second portion removably attached to said first portion, said second portion containing a hole, said first and second portion holes being aligned when said first and second portions are in position for lock operation, with said motor and said bolt means attached to said second portion; and a pin for insertion through said first and second portion holes to maintain the relative position of said first and second portions.

6. The lock of claim 1, wherein said means for selectively activating the motor comprises:

means for determining and indicating when the lock is fully open;

means for determining and indicating when the lock is fully closed;

circuit means for activating said motor when said bolt means has been inserted into said bolt engagement means and said fully closed determination means indicates that the lock is fully closed; and circuit means for activating said motor when said bolt means has been withdrawn from said bolt engagement means and said fully open determination means indicates that the lock is fully open.

7. The lock of claim 6, further comprising:

timer means connected to said fully closed motor activation circuit means and said fully open motor activation circuit means for enabling said fully closed motor activation circuit means and said fully open motor activation circuit means to allow the opening and closing of the lock.

8. The lock of claim 7, wherein said timer means includes a 24 hour timer having controllable switch contacts for allowing the opening of the lock at certain preset times for a preset duration and allowing the closing of the lock and the retaining of it closed at the remaining times.

9. The lock of claim 7, wherein said timer means includes a short interval timer for opening the lock for a short interval and allowing the closing of the lock after the interval is completed.

10. The lock of claim 9, wherein said short interval timer is a five minute timer.

11. The lock of claim 6, further comprising a switch connected to said fully closed motor activation circuit means for defeating operation of said fully closed motor activation circuit means when said switch is unactivated and allowing operation of said fully closed motor activation circuit means when said switch is activated.

12. The lock of claim 7, further comprising a switch connected to said fully closed motor activation circuit means for defeating operation of said fully closed motor activation circuit means when said switch is unactivated and allowing operation of said fully closed motor activation circuit means when said switch is activated.

13. The lock of claim 12, further comprising an override switch connected to said timer means and said defeating switch for selectively overriding the operation of said timer means and said defeating switch, said override switch overriding said timer means and said defeating switch for only the interval said override switch is activated.

* * * * *

UNITED STATES PATENT AND TRADEMARK OFFICE

CERTIFICATE OF CORRECTION

PATENT NO. : 4,799,719

DATED : January 24, 1989

INVENTOR(S) : George Wood

It is certified that error appears in the above-identified patent and that said Letters Patent is hereby corrected as shown below:

On the cover page, please amend the inventor's name to reflect his middle initial -- H. --.

Signed and Sealed this

Fourth Day of July, 1989

*Attest:*

*Attesting Officer*

DONALD J. QUIGG

*Commissioner of Patents and Trademarks*